US010885842B2

(12) United States Patent
Kang et al.

(10) Patent No.: US 10,885,842 B2
(45) Date of Patent: Jan. 5, 2021

(54) DISPLAY DEVICE AND A METHOD OF DRIVING THE SAME

(71) Applicant: Samsung Display Co., Ltd., Yongin-si (KR)

(72) Inventors: Chul Kyu Kang, Suwon-si (KR); Sang Moo Choi, Yongin-si (KR); Dongsun Lee, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/513,627

(22) Filed: Jul. 16, 2019

(65) Prior Publication Data

US 2020/0027389 A1 Jan. 23, 2020

(30) Foreign Application Priority Data

Jul. 17, 2018 (KR) ..... 10-2018-0082960

(51) Int. Cl.
*G09G 3/32* (2016.01)
*G09G 3/325* (2016.01)
*G09G 3/3266* (2016.01)

(52) U.S. Cl.
CPC ..... *G09G 3/325* (2013.01); *G09G 3/3266* (2013.01); *G09G 2320/02* (2013.01); *G09G 2330/028* (2013.01)

(58) Field of Classification Search
CPC ... G09G 2300/0819; G09G 2300/0861; G09G 2310/0286; G09G 2320/02; G09G 2320/103; G09G 2330/028; G09G 3/3233; G09G 3/325; G09G 3/3266
USPC ..... 345/98–103, 210–215
See application file for complete search history.

(56) References Cited

U.S. PATENT DOCUMENTS

| | | | | |
|---|---|---|---|---|
| 9,330,601 | B2 | 5/2016 | Lee et al. | |
| 9,734,759 | B2 | 8/2017 | Kim et al. | |
| 9,805,651 | B2 | 10/2017 | Kim | |
| 2010/0085348 | A1* | 4/2010 | Bae | G09G 3/3648 345/213 |
| 2011/0115839 | A1* | 5/2011 | Takahashi | H01L 27/3262 345/698 |
| 2011/0221726 | A1* | 9/2011 | Huitema | G09G 3/348 345/209 |

(Continued)

FOREIGN PATENT DOCUMENTS

| | | |
|---|---|---|
| KR | 10-2015-0076868 | 7/2015 |
| KR | 10-2015-0144893 | 12/2015 |

(Continued)

*Primary Examiner* — Tony O Davis
(74) *Attorney, Agent, or Firm* — H.C. Park & Associates, PLC

(57) ABSTRACT

A display device includes: a display panel including: a scan line, a data line, and an emission control line; a pixel including: a plurality of transistors connected to the scan line, the data line and the emission control line; and an organic light-emitting diode driven by the plurality of transistors, and a scan driver configured to: in response to an image mode being a moving image mode, generate a first mode scan signal having a turning-on voltage of a transistor for a plurality of horizontal periods; and in response to the image mode being a static image mode, generate a second mode scan signal having the turning-on voltage for a single horizontal period.

18 Claims, 8 Drawing Sheets

(56) References Cited

U.S. PATENT DOCUMENTS

| | | | | |
|---|---|---|---|---|
| 2014/0210700 | A1* | 7/2014 | Won | G09G 3/3677 345/102 |
| 2014/0313181 | A1* | 10/2014 | Hong | G09G 3/2003 345/212 |
| 2014/0320479 | A1* | 10/2014 | Kaneko | G02F 1/13306 345/212 |
| 2015/0022512 | A1* | 1/2015 | Ahn | G09G 3/3614 345/212 |
| 2015/0194121 | A1* | 7/2015 | Lee | G09G 3/3677 345/212 |
| 2017/0098413 | A1* | 4/2017 | Lee | G11C 19/28 |
| 2017/0103726 | A1* | 4/2017 | Shin | G09G 3/3688 |

FOREIGN PATENT DOCUMENTS

| | | |
|---|---|---|
| KR | 10-2016-0130066 | 11/2016 |
| KR | 10-1816891 | 1/2018 |

* cited by examiner

DISPLAY DEVICE AND A METHOD OF DRIVING THE SAME

CROSS REFERENCE AND RELATED APPLICATION

This application claims priority from and the benefit of Korean Patent Application No. 10-2018-0082960, filed on Jul. 17, 2018, which is hereby incorporated by reference for all purposes as if fully set forth herein.

BACKGROUND

Field

Exemplary embodiments of invention relate generally to a display device and a method of driving the display device and, more specifically, to a display device for improving a display quality and a method of driving the display device.

Discussion of the Background

Recently, various flat panel display devices that have weight and size advantages over conventional display devices such as Cathode Ray Tube (CRT) have been developed. Examples of the flat panel display devices include a liquid crystal display (LCD) device, a field emission display (FED) device, a plasma display panel PDP, and an organic light-emitting display (OLED) device.

The OLED device has advantages such as a rapid response speed and low power consumption because the OLED device uses an organic light-emitting diode that emits a light based on recombination of electrons and holes.

The OLED device includes a plurality of pixels and each pixel includes a pixel circuit which includes an organic light-emitting diode and a plurality of transistors driving the organic light-emitting diode.

The above information disclosed in this Background section is only for understanding of the background of the inventive concepts, and, therefore, it may contain information that does not constitute prior art.

SUMMARY

Devices constructed according to exemplary implementations of the invention provide a display device with an improved display quality. Also, methods according to exemplary implementations of the invention provide an improved method of driving the display device.

Additional features of the inventive concepts will be set forth in the description which follows, and in part will be apparent from the description, or may be learned by practice of the inventive concepts.

According to one or more embodiments of the invention, a display device includes: a display panel including: a scan line, a data line, and an emission control line; a pixel including: a plurality of transistors connected to the scan line, the data line and the emission control line; and an organic light-emitting diode driven by the plurality of transistors, and a scan driver configured to: in response to an image mode being a moving image mode, generate a first mode scan signal having a turning-on voltage of a transistor for a plurality of horizontal periods; and in response to the image mode being a static image mode, generate a second mode scan signal having the turning-on voltage for a single horizontal period.

The display device may further include: a timing controller configured to provide: a first mode start pulse signal having the turning-on voltage for a plurality of horizontal periods with the scan driver in the moving image mode; and a second mode start pulse signal having the turning-on voltage for a single horizontal period with the scan driver in the static image mode.

The scan driver may be configured to output a first scan signal to a scan line of the display panel in response to a start pulse signal, wherein the first scan signal may have a same phase as the start pulse signal and may be delayed by a horizontal period from the start pulse signal.

The first mode scan signal may have the turning-on voltage for a current horizontal period and at least one previous horizontal period, and the at least one previous horizontal period may be prior to the current horizontal period by a k horizontal period, wherein 'k' is an even number which is equal to or more than 2.

The first mode scan signal may have the turning-on voltage for q number of horizontal periods, wherein 'q' is a number which is equal to or more than 2.

The pixel may include a switching transistor configured to apply a data voltage to a capacitor in response to a scan signal, a driving transistor configured to transfer a driving current toward the organic light-emitting diode based on a voltage charged in the capacitor, and a light-emitting transistor configured to apply the driving current to the organic light-emitting diode in response to an emission control signal.

The pixel may further include an initializing transistor configured to apply an initialization voltage to the capacitor in response to a pixel initialization signal.

In an exemplary embodiment, when the scan signal is an j-th scan signal, the pixel initialization signal may be an (j−1)-th scan signal.

The display device may further include an emission driver is configured to output the emission control signal to the emission control line.

The transistor may be a P-type transistor.

According to one or more embodiments of the invention, a method of driving a display device which includes a pixel including a plurality of transistors connected to a scan line, a data line and an emission control line and an organic light-emitting diode driven by the plurality of transistors in response to a display mode, the method including: generating, in response to the display mode being a moving image mode, a first mode scan signal having a turning-on voltage of a transistor for a plurality of horizontal periods; and generating, in response to the display mode being a static image mode, a second mode scan signal having the turning-on voltage for a single horizontal period.

The method may further include generating, in response to the display mode being the moving image mode, a first mode start pulse signal having the turning-on voltage for a plurality of horizontal periods; and generating, in response to the display mode being the static image mode, a second mode start pulse signal having the turning-on voltage for a single horizontal period.

The method may further include: transmitting a first scan signal to a scan line of the display device in response to a start pulse signal, wherein the first scan signal has a same phase as the start pulse signal and is delayed by a horizontal period from the start pulse signal.

The first mode scan signal may have the turning-on voltage for a current horizontal period and at least one horizontal period prior to the current horizontal period by a k horizontal period, and wherein 'k' is an even number which is equal to or more than 2.

The first mode scan signal may have the turning-on voltage for q number of horizontal periods, wherein 'q' is a number which is equal to or more than 2.

The pixel may include a switching transistor configured to apply a data voltage to a capacitor in response to a scan signal, a driving transistor configured to transfer a driving current toward the organic light-emitting diode based on a voltage charged in the capacitor; and a light-emitting transistor configured to apply the driving current to the organic light-emitting diode in response to an emission control signal.

The pixel may further include an initializing transistor configured to apply an initialization voltage to the capacitor in response to a pixel initialization signal.

In an exemplary embodiment, when the scan signal may be an j-th scan signal, the pixel initialization signal is an (j−1)-th scan signal.

The method may further include outputting output the emission control signal to the emission control line.

The transistor may be a P-type transistor.

According to the inventive concept, the scan signal has the turning-on voltage for the current horizontal period and at least one previous horizontal period is used in the moving image mode, and thus, the step efficiency S/E of the moving image may be improved. In addition, the general scan signal is used in the static image mode, and thus, the text ghost phenomenon of the static image may be eliminated.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
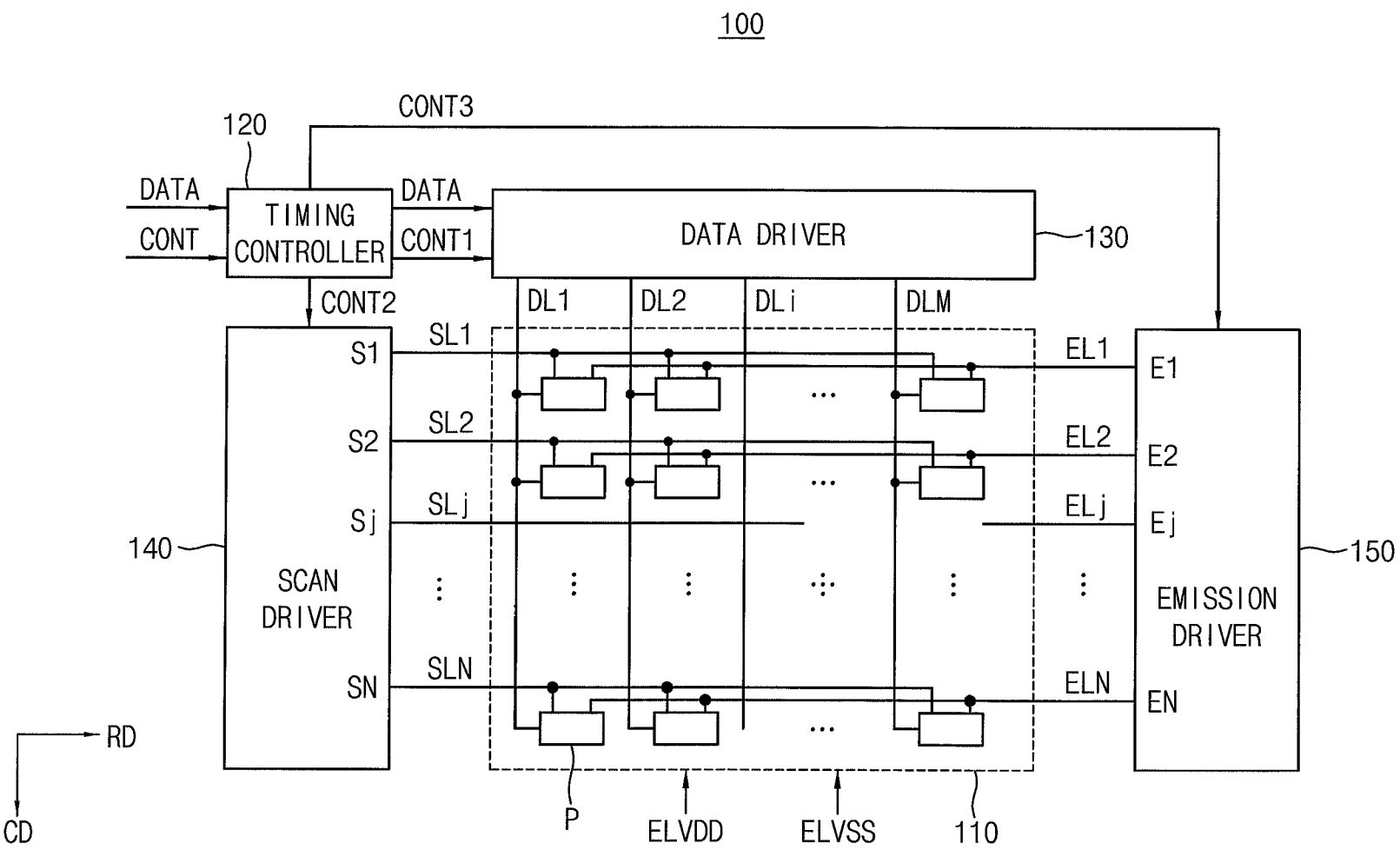
FIG. 1 is a block diagram illustrating a display device constructed according to one exemplary embodiment.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, a column direction CD and a row direction RD are not limited to axes of a rectangular coordinate system, such as the x, y, and z-axes, and may be interpreted in a broader sense. For example, the column direction CD and the row direction RD may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

shapes of regions of a device and, as such, are not necessarily intended to be limiting.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram illustrating a display device constructed according to one exemplary embodiment.

Referring to FIG. 1, the display device 100 may include a display panel 110, a timing controller 120, a data driver 130, a scan driver 140, and an emission driver 150.

The display panel 110 may include a plurality of pixels P, a plurality of scan lines SL1, . . . , SLj, . . . , SLN, a plurality of data lines DL1, . . . , DLi, . . . , DM and a plurality of emission control lines EL1, . . . , ELj, . . . , ELN ('i', 'j', 'M' and 'N' are natural numbers, wherein i is equal to or smaller than M and j is equal to or smaller than N).

The pixels P may be arranged as a matrix type which includes a plurality of pixel rows and a plurality of pixel columns. The pixel row corresponds to a horizontal line and the pixel column corresponds to a vertical line.

Each pixel P includes a pixel circuit, and the pixel circuit includes a plurality of transistor connected to a scan line, a data line and an emission control line and an organic light emitting diode driven by the plurality of transistors.

The data lines DL1, . . . , DLi, . . . , DLM may extend in a column direction CD and be arranged in a row direction RD. The data lines DL1, . . . , DLi, . . . , DLM are connected to the data driver 130 and transfer data voltages to the pixels P.

The scan lines SL1, . . . , SLj, . . . , SLN may extend in the row direction RD, and be arranged in the column direction CD. The scan lines SL1, . . . , SLj, . . . , SLN are connected to the scan driver 140 and transfer scan signals the pixels P.

The emission control lines EL1, . . . , ELj, . . . , ELN may extend in the row direction RD, and be arranged in the column direction CD. The emission control lines EL1, . . . , ELj, . . . , ELN are connected to the emission driver 150 and transfer emission control signals to the pixels P.

In addition, the pixels P may receive a first power source voltage ELVDD and a second power source voltage ELVSS.

Each of the pixels P may receive a data voltage in response to the scan signal, and emit a light corresponding to the data voltage using the first and second power source voltages ELVDD and ELVSS.

The timing controller 120 may receive an image signal DATA and a control signal CONT from an external device. The image signal DATA may include red, green and blue data. The control signal CONT may include a horizontal synchronization signal, a horizontal synchronization signal, a main clock signal, etc.

The control signal CONT may include an image information signal is a signal which notices whether the image signal is a moving image signal or a static image signal. For example, when the image information signal is a first signal, the image signal may be the moving image signal and when the image information signal is a second signal, the image signal may be the static image signal.

The timing controller 120 may convert the image signal DATA to image data corresponding to a pixel structure and a resolution of the display panel 110 and provides the image data to the data driver 130.

The timing controller 120 may generate a first control signal CONT1 for driving the data driver 130, a second control signal CONT2 for driving the scan driver 140 and a third control signal CONT3 for driving the emission driver 150 based on the control signal CONT.

According to an exemplary embodiment, the timing controller 120 may generate the second control signal CONT2 controlling the scan driver 140 based on the image information signal. The second control signal CONT2 may control a start timing period in which an operation of the scan driver 140 begins.

For example, when the image information signal is a high signal corresponding to the moving image, the timing controller 120 is configured to generate a first start pulse signal having a turning-on voltage of a transistor for a plurality of horizontal periods in a frame period. However, when the image information signal is a low signal corresponding to the static image, the timing controller 120 is configured to generate a second start pulse signal having the turning-on voltage for a single horizontal period in the frame period. The timing controller 120 may be selectively provide the scan driver 140 with the first start pulse signal for a moving image mode and the second start pulse signal for a static image mode based on the image information signal.

The data driver 130 is configured to convert the image signal DATA to a data voltage in response to the first control signal CONT1 and to output the data voltage to the data lines DL1, . . . , DLi, . . . , DLM.

The scan driver 140 may generate a plurality of scan signals S1, . . . , Sj, . . . , SN in response to the second control signal CONT2.

According to an exemplary embodiment, in the moving image mode, the scan driver 140 is configured to generate a scan signal of an MC q-clk mode for the current horizontal period in response to the first start pulse signal. (q refers to a natural number equal to or greater than 2). The scan signal of the MC q-clk mode refers to a scan signal having turning-on voltages to turn on the corresponding transistor in the pixel P for q number of horizontal periods including the current horizontal period and at least one horizontal period prior to the current horizontal period by a k horizontal period ('k' is an even number which is equal to or more than 2). For example, the scan signal of an MC 3-clk mode for an j-th horizontal period may have the turning-on voltage for the j-th horizontal period, an (j−2)-th horizontal period, and an (j−4)-th horizontal period, in which case, k is 2 and 4.

According to an exemplary embodiment, in the static image mode, the scan driver 140 is configured to generate a general scan signal of an MC 1-clk mode in response to the second start pulse signal. The general scan signal of the MC 1-clk mode refers to a scan signal having the turning-on voltage for the current horizontal period. For example, the scan signal of the MC 1-clk mode for the j-th horizontal period may have the turning-on voltage for the j-th horizontal period that is the current horizontal period.

Generally, characteristics of the transistor driving an organic light emitting diode (OLED) differ between when the organic light emitting diode displays a white grayscale and a black grayscale. Thus, when a black grayscale changes to the white grayscale, a luminance changes do not occur immediately and occur gradually during a plurality of frames. A luminance ratio of displaying the white grayscale in a first frame among the plurality of frames to displaying full white grayscale after the plurality of frames is called a step efficiency (S/E). The S/E decreases by hysterical characteristics of the transistor. To compensate for the decreased S/E, the scan signal of the MC q-clk mode is applied to the transistor in the pixel.

The scan signal of the MC q-clk mode may have a turning-on voltage turning on a transistor for q horizontal periods which includes a current horizontal period and at least one previous horizontal period. When the scan signal of the MC q-clk mode is applied to the pixel circuit, a previous data voltage is pre-charged before a self data voltage is charged and thus, the step efficiency S/E may improve. By increasing the 'q' number, the step efficiency S/E may be increased.

According to an exemplary embodiment, the scan signal of the MC 3-clk mode is used in the moving image mode and the scan signal of the MC 1-clk mode is used in the static image mode. Thus, in the moving image mode where the step efficiency S/E is important, the number of the horizontal period in which the scan signal has the turning-on voltage is increased to improve the display quality. However, in the static image mode where the step efficiency S/E is not important, the number of horizontal periods in which the scan signal has the turning on voltage is decreased to reduce a power consumption.

The emission driver 150 is configured to generate a plurality of light-emitting control signals in response to the third control signal CONT3. The emission driver 150 is configured to simultaneously or sequentially output a plurality of light-emitting control signals E1, . . . , Ej, . . . , EN to the emission control lines EL1, . . . , ELj, . . . , ELN based on the third control signal CONT3.

In exemplary embodiments, the timing controller 120, the data driver 130, the scan driver 140, the emission driver 150, and/or one or more components thereof, may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like.

According to one or more exemplary embodiments, the features, functions, processes, etc., described herein may be implemented via software, hardware (e.g., general processor, digital signal processing (DSP) chip, an application specific integrated circuit (ASIC), field programmable gate arrays (FPGAs), etc.), firmware, or a combination thereof. In this manner, the timing controller 120, the data driver 130, the scan driver 140, the emission driver 150, and/or one or more components thereof may include or otherwise be associated with one or more memories (not shown) including code (e.g., instructions) configured to cause the timing controller 120, the data driver 130, the scan driver 140, the emission driver 150, and/or one or more components thereof to perform one or more of the features, functions, processes, etc., described herein.

The memories may be any medium that participates in providing code to the one or more software, hardware, and/or firmware components for execution. Such memories may be implemented in any suitable form, including, but not limited to, non-volatile media, volatile media, and transmission media. Non-volatile media include, for example, optical or magnetic disks. Volatile media include dynamic memory. Transmission media include coaxial cables, copper wire and fiber optics. Transmission media can also take the form of acoustic, optical, or electromagnetic waves. Common forms of computer-readable media include, for example, a floppy disk, a flexible disk, hard disk, magnetic tape, any other magnetic medium, a compact disk-read only memory (CD-ROM), a rewriteable compact disk (CD-RW), a digital video disk (DVD), a rewriteable DVD (DVD-RW), any other optical medium, punch cards, paper tape, optical mark sheets, any other physical medium with patterns of holes or other optically recognizable indicia, a random-access memory (RAM), a programmable read only memory (PROM), and erasable programmable read only memory (EPROM), a FLASH-EPROM, any other memory chip or cartridge, a carrier wave, or any other medium from which information may be read by, for example, a controller/processor.

Figure 2:
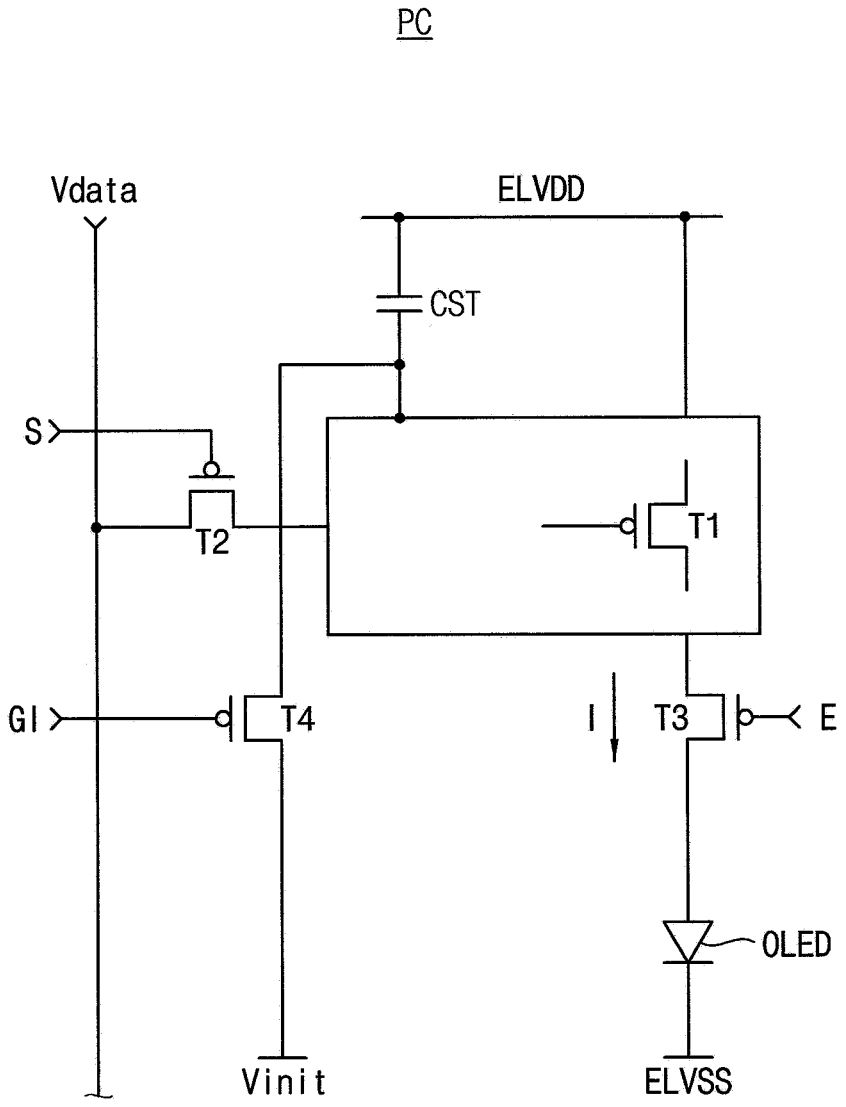
FIG. 2 is a circuit diagram illustrating an unit pixel circuit constructed according to one exemplary embodiment.

FIG. 2 is a circuit diagram illustrating an unit pixel circuit constructed according to one exemplary embodiment.

Referring to FIGS. 1 and 2, for example, the pixel circuit PC of the pixel P may include an organic light-emitting diode (OLED), a driving transistor T1, a capacitor CST, a switching transistor T2, a light-emitting transistor T3, and an initializing transistor T4.

According to an exemplary embodiment, the transistor is a P-type transistor which is turned on in response to a low voltage (tuning-on voltage) applied to a gate electrode of the transistor and is turned off in response to a high voltage applied to the gate electrode of the transistor. Alternatively, the transistor may be an N-type transistor which is turned on in response to a high voltage (tuning-on voltage) applied to a gate electrode of the transistor and is turned off in response to a low voltage applied to the gate electrode of the transistor.

The driving transistor T1 includes a gate electrode connected to the switching transistor T2, a first electrode receiving the first power source voltage ELVDD, and a second electrode connected to the light-emitting transistor T3. When the driving transistor T1 is turned on, a driving current I corresponding to the data voltage charged in the capacitor CST flows.

The capacitor CST includes a first electrode receiving the first power source voltage ELVDD and a second electrode connected to the gate electrode of the driving transistor T1.

The switching transistor T2 includes a gate electrode receiving a scan signal S, the first electrode receiving the data voltage Vdata and a second electrode connected to the gate electrode of the driving transistor T1. When the switching transistor T2 is turned on, the data voltage Vdata is applied to the capacitor CST.

The light-emitting transistor T3 includes a gate electrode receiving the emission control signal E, a first electrode connected to the second electrode of the driving transistor T1 and a second electrode connected to the organic light-emitting diode OLED. When the light-emitting transistor T3 is turned on, the driving current I through the driving transistor T1 is applied to the organic light-emitting diode OLED. Then, the organic light-emitting diode OLED emits the light.

The organic light-emitting diode OLED includes a first electrode connected to the light-emitting transistor T3 and a second electrode receiving the second power source voltage ELVSS.

The initializing transistor T4 includes a gate electrode receiving the pixel initialization signal GI and a first electrode receiving the initializing voltage Vinit and a second electrode connected to the capacitor CST. When the initializing transistor T4 is turned on, the initializing voltage Vinit is applied to the capacitor CST. The pixel initialization signal GI may be a previous signal prior to the scan signal S. For example, when the scan signal S is an j-th scan signal corresponding to an j-th horizontal period of the frame period, the pixel initialization signal GI is an (j−1)-th scan signal corresponding to an (j−1)-th horizontal period of the frame period.

The pixel circuit is not limited to the pixel circuit in FIG. 2, but may be implemented in a variety of circuits.

Figure 3:
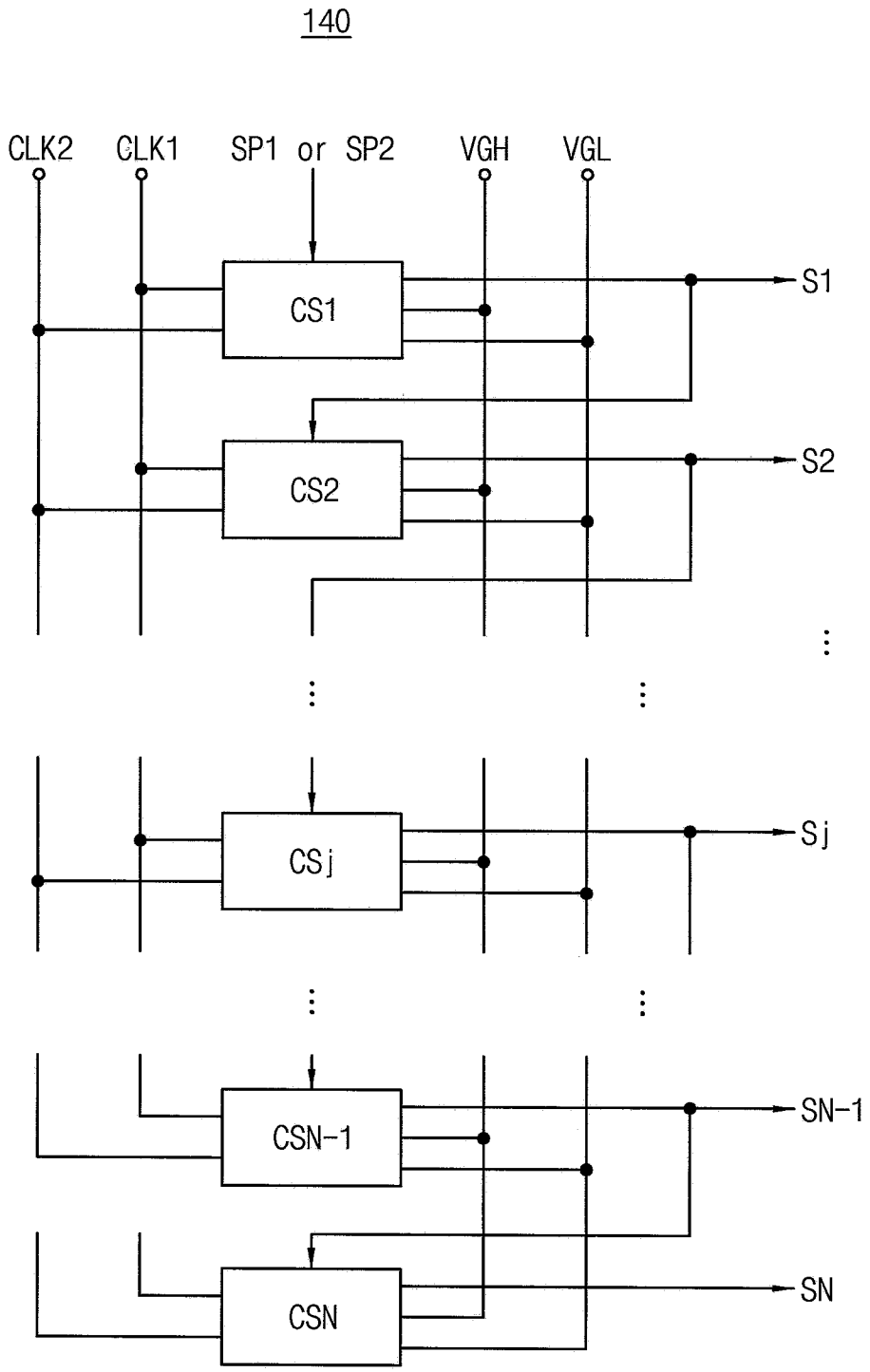
FIG. 3 is a block diagram illustrating a scan driver constructed according to one exemplary embodiment.

FIG. 3 is a block diagram illustrating a scan driver constructed according to one exemplary embodiment.

Referring to FIGS. 1 and 3, the scan driver 140 may include plurality of circuit stages CS1, . . . , CSj, . . . , CSN−1 and CSN which is connected to dependent on each other and outputs a plurality of scan signals S1, S2, . . . , Sj, . . . , SN−1 and SN.

According to an exemplary embodiment, the scan driver 140 may sequentially output a plurality of scan signals S1, S2, . . . , Sj, . . . , SN−1 and SN.

The circuit stages CS1, . . . , CSj, . . . , CSN−1 and CSN receive a carry signal, a first driving voltage VGL, a second driving voltage VGH, a first clock signal CLK1 and a second clock signal CLK2.

The carry signal may be a start pulse signal provided from the timing controller 120 or a previous scan signal provided from a previous circuit stage.

According to an exemplary embodiment, in the moving image mode, a first circuit stage CS1 receives a first start pulse signal SP1 as the carry signal. The first start pulse signal SP1 has a turning-on voltage turning on a transistor for a plurality of horizontal periods of the frame period (the scan signal of the MC q-clk mode).

However, in the static image mode, the first circuit stage CS1 receives a second start pulse signal SP2. The second start pulse signal SP2 has a turning-on voltage for the current horizontal period of the frame period (the scan signal of the MC 1-clk mode).

The first circuit stage is driven in response to the start pulse signal SP1 or SP2 provided from the timing controller 120 and is configured to generate a first scan signal S1 delayed by 1 horizontal period 1H from the start pulse signal SP1 or SP2.

The second circuit stage CS2 receives a first scan signal S1 from the first circuit stage CS1 that is a previous circuit stage as the carry signal, and is configured to generate a second scan signal S2 delayed by 1 horizontal period 1H from the first scan signal S1 in response to the first scan signal S1.

The first driving voltage VGL has a first level and the second driving voltage VGH has a second level higher than the first level. For example, the first driving voltage VGL may have a low voltage L and the second driving voltage VGH may have a high voltage H.

The first and second driving voltages VGL and VGH are applied to the circuit stages CS1 . . . , CSj, . . . , CSN, commonly.

The first clock signal CLK1 is an alternating current (AC) signal which swings between the first level and the second level different from the first level. The first clock signal CLK1 may be synchronized with an even numbered scan signal outputted from an even numbered circuit stage among the circuit stages CS CSj, . . . , CSN−1 and CSN.

The second clock signal CLK2 may be delayed by 1 horizontal period 1H from the first clock signal CLK1. For example, the second clock signal CLK2 may be synchronized with an odd numbered scan signal outputted from an odd numbered circuit stage among the circuit stages CS1, . . . , CSj, . . . , CSN−1 and CSN.

Figure 4:
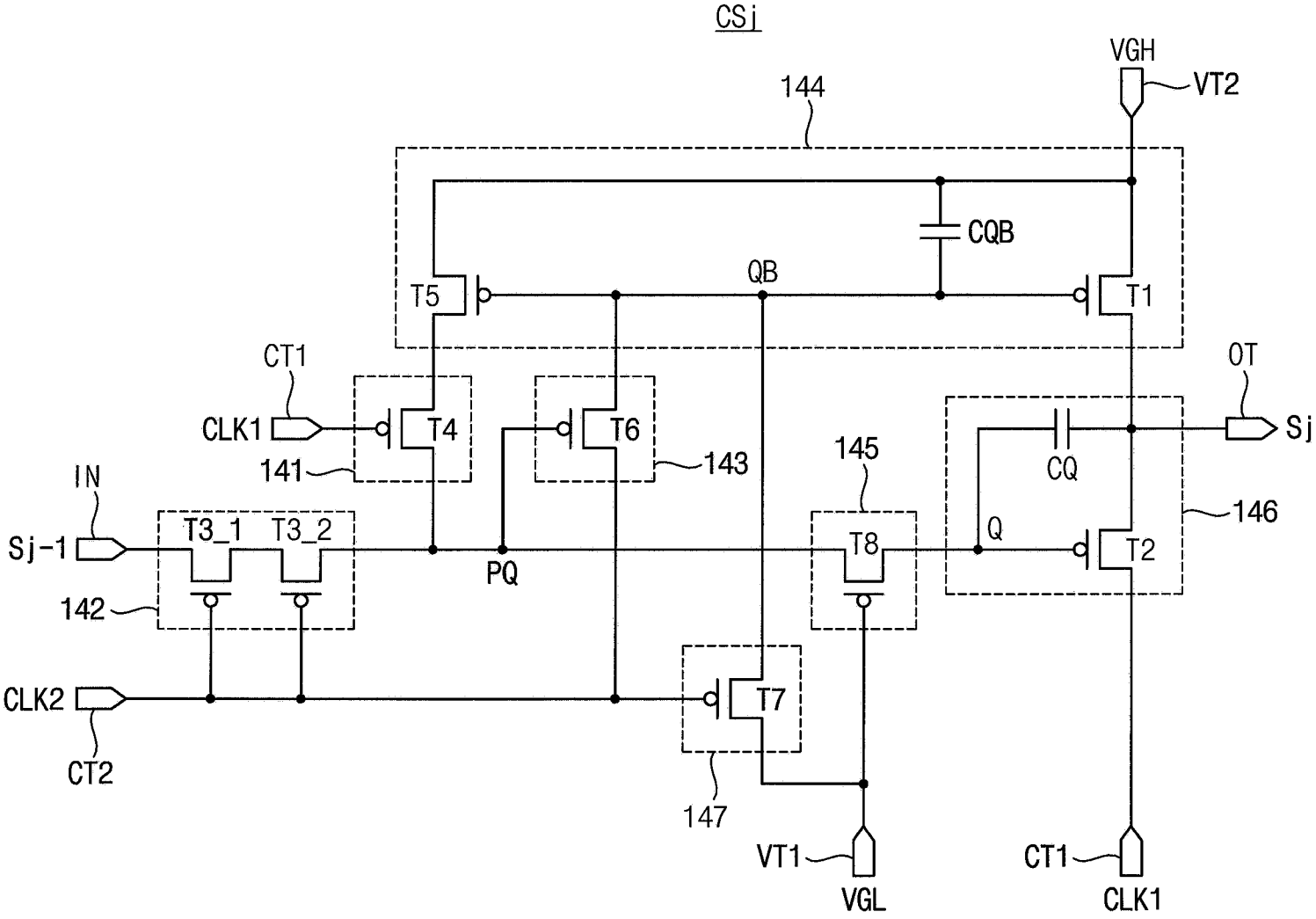
FIG. 4 is a circuit diagram illustrating a circuit stage of the scan driver constructed according to one exemplary embodiment.

FIG. 4 is a circuit diagram illustrating a circuit stage SCj of the scan driver 140 constructed according to one exemplary embodiment.

Referring to FIGS. 3 and 4, the j-th circuit stage CSj includes an input terminal IN, a first clock terminal CT1, a second clock terminal CT2, a first driving voltage terminal VT1, a second driving voltage terminal VT2, and an output terminal OT.

The input terminal IN receives an (j−1)-th scan signal Sj−1 form a previous circuit stage CSj−1 as the carry signal.

The first clock terminal CT1 receives the first clock signal CLK1.

The second clock terminal CT2 receives the second clock signal CLK2 delayed from the first clock signal CLK1. For example, the second clock signal CLK2 may be delayed by 1 horizontal period 1H from the first clock signal CLK1.

The first driving voltage terminal VT1 receives the first driving voltage VGL. The first driving voltage VGL may have the low voltage L.

The second driving voltage terminal VT2 receives the second driving voltage VGH. The second driving voltage VGH may have the high voltage H.

The output terminal OT outputs an output signal that is an j-th scan signal Sj.

Hereinafter, the circuit stage is explained as an example of the j-th circuit stage CSj. The transistor in the circuit stage is a P-type transistor which is turned on in response to a low voltage (tuning-on voltage) applied to a gate electrode of the transistor and is turned off in response to a high voltage applied to the gate electrode of the transistor. Alternatively, the transistor may be an N-type transistor which is turned on in response to a high voltage (tuning-on voltage) applied to a gate electrode of the transistor and is turned off in response to a low voltage applied to the gate electrode.

Referring to the j-th circuit stage CSj, the input terminal IN receives the (j−1)-th scan signal Sj−1 as the carry signal, the first clock terminal CT1 receives the first clock signal CLK1, the second clock terminal CT2 receives the second clock signal CLK2 and the output terminal OT outputs the j-th scan signal Sj.

The j-th circuit stage CSj may include a first input part 141, a second input part 142, a first output controlling part 143, a first output part 144, a second output controlling part 145, a second output part 146, and a holding part 147.

The first input part 141 transfer a signal of a first node (PQ node) PQ to a second node (QB node) QB in response to a first clock signal CLK1 received from first clock terminal CT1. The first input part 141 includes a fourth transistor T4. The fourth transistor T4 includes a gate electrode connected to a first clock terminal CT1, a first electrode connected to the PQ node PQ and a second electrode connected to the first output part 144.

The second input part 142 transfers an (j−1)-th scan signal Sj−1 received from the input terminal IN to the PQ node PQ in response to the second clock signal CLK2 received from the second clock terminal CT2. The second input part 142 includes a third transistor T3-1 and T3-2. The third transistor T3-1 and T3-2 includes a gate electrode connected to the second clock terminal CT2, a first electrode connected to the input terminal IN and a second electrode connected to the PQ node PQ.

The first output controlling part 143 transfers the second clock signal CLK2 received from the second clock terminal CT2 to the QB node QB in response to a signal of the PQ node PQ. The first output controlling part 143 includes a sixth transistor T6. The sixth transistor T6 includes a gate electrode connected to the PQ node PQ, a first electrode connected to the second clock terminal CT2 and a second electrode connected to the QB node QB.

The first output part 144 transfers the third clock signal GCK received from the third clock terminal CT3 to the output terminal OT in response to a signal of the QB node QB. The first output part 144 includes a first transistor T1, a first capacitor CQB and a fifth transistor T5.

The first transistor T1 includes a gate electrode connected to the QB node QB, a first electrode connected to the second driving voltage terminal VT2 and a second electrode connected to the output terminal OT. The first capacitor CQB includes a first electrode connected to the second driving voltage terminal VT2 and a second electrode connected to the QB node QB. The fifth transistor T5 includes a gate electrode connected to the QB node QB, a first electrode connected to the second driving voltage terminal VT2 and a second electrode connected to the second electrode of the fourth transistor T4.

The second output controlling part 145 transfers a signal of the PQ node PQ to a third node (Q node) Q in response to the first driving voltage VGL received from the first driving voltage terminal VT1. The second output controlling part 145 includes an eighth transistor T8. The eighth transistor T8 includes a gate electrode connected to the first driving voltage terminal VT1, a first electrode connected to the PQ node PQ and a second electrode connected to the Q node Q.

The second output part 146 transfers the first clock signal CLK1 received from the first clock terminal CT1 to the output terminal OT in response to a signal of the Q node Q. The second output part 146 includes a second transistor T2 and a second capacitor CQ. The second transistor T2 includes a gate electrode connected to the Q node Q, a first electrode connected to the first clock terminal CT1 and a second electrode connected to the output terminal OT. The second capacitor CQ includes a first electrode connected to the output terminal OT and a second electrode connected to the Q node Q.

The holding part 147 applies the first driving voltage VGL received from the first driving voltage terminal VT1 to the QB node QB in response to the second clock signal CLK2 received from the second clock terminal CT2. The holding part 147 includes a seventh transistor T7. The seventh transistor T7 includes a gate electrode connected to the second clock terminal CT2, a first electrode connected to the first driving voltage terminal VT1 and a second electrode connected to the QB node QB.

Figure 5:
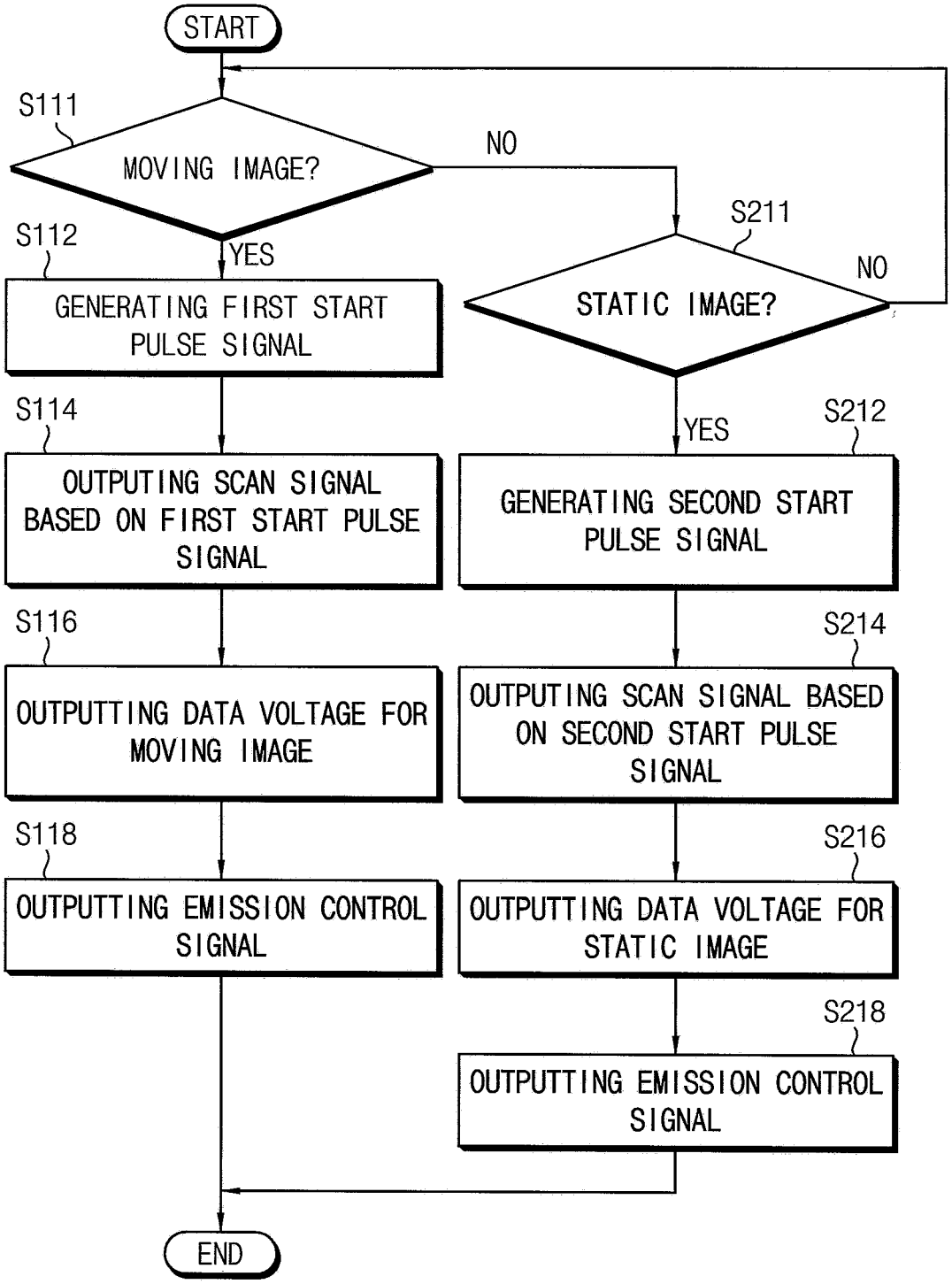
FIG. 5 is a flowchart diagram illustrating a method of driving a display device constructed according to one exemplary embodiment.

FIG. 5 is a flowchart diagram illustrating a method of driving a display device constructed according to one exemplary embodiment.

Referring to FIGS. 1, 3, and 5, the timing controller 120 receives the image signal and the image information signal corresponding to the image signal.

The timing controller 120 determines whether the image signal is the moving image or the static image based on the image information signal (Step S111 and Step S211).

When the image signal is the moving image, the timing controller 120 generates a first start pulse signal (Step S112).

The first start pulse signal has the turning-on voltage turning on the transistor for q horizontal periods (MC q-clk mode). The 'q' is a natural number being equal to or more than 2. The q horizontal periods may include a current horizontal period and at least one previous horizontal period with respect to the current horizontal period.

For example, the first start pulse signal has the turning-on voltage for a current horizontal period H0 and the at least one previous horizontal period H0-*k* being prior to the current horizontal period H0 by a k horizontal period ('k' is an even number which is equal to or more than 2). The current horizontal period of the start pulse signal may be prior to a first horizontal period H1 of the frame period.

For example, the first start pulse signal of the MC 3-clk mode may have the turning-on voltage for a current horizontal period H0, a first previous horizontal period H−2 being prior to the current horizontal period H0 by a 2 horizontal period and a second previous horizontal period H−4 being prior to the current horizontal period H0 by a 4 horizontal period. In another example, the first start pulse signal of the MC 3-clk mode may have the turning-on voltage for a current horizontal period H0, a first previous horizontal period H−4 being prior to the current horizontal period H0 by a 4 horizontal period and a second previous horizontal period H−8 being prior to the current horizontal period H0 by a 8 horizontal period.

Depending on the characteristics of the display panel corresponding to the moving image mode, 'k' and 'q' may be predetermined in various ways.

The scan driver 140 is configured to sequentially output a plurality of scan signals having a same phase as the first start pulse signal by 1 horizontal period 1H (Step S114).

For example, the first scan signal S1 has the turning-on voltage for the first horizontal period H1 that is the current horizontal period and the at least one previous horizontal period H1-*k* being prior to the first horizontal period H1 by k horizontal period.

As the described above, the j-th scan signal Sj has the turning-on voltage for the j-th horizontal period Hn that is the current horizontal and the at least one previous horizontal period Hn−k being prior to the j-th horizontal period Hn by k horizontal period.

The scan driver 140 is configured to the plurality of scan lines SL1, . . . , SLj, . . . SLN of the display panel 110 with the plurality of scan signals for the moving image in response to the first start pulse signal.

The data driver 130 is configured to generate the data voltage of the moving image and to provide the plurality of data lines DL1, . . . , DLi, . . . , DLM of the display panel 110 with the data voltage of the moving image (Step S116).

The emission driver 150 is configured to generate the plurality of emission control signals E1, . . . , Ej, . . . , EN and to provide the plurality of emission control lines EL1, . . . , ELj, . . . , ELN of the display panel 110 with the plurality of emission control signals E1, . . . , Ej, . . . , EN (Step S118).

Therefore, the display panel 110 may displays the moving image which is rarely viewed as a text ghost phenomenon. Thus, in the moving image mode, the step efficiency S/E may be improved and thus, the display quality of the moving image may be improved.

According to the exemplary embodiment, the scan signal of the MC q-clk mode is used in the moving image mode and thus, the step efficiency S/E may be improved.

However, when the image signal is the static image, the timing controller 120 is configured to generate the second start pulse signal different from the first start pulse signal (Step S212).

The second start pulse signal has the turning-on voltage turning on the transistor for the current horizontal period H0 such as a general start pulse signal (MC 1-clk mode).

The scan driver 140 is configured to sequentially output a plurality of scan signals having a same phase as the second start pulse signal by 1 horizontal period 1H (Step S214).

For example, the first scan signal S1 has the turning-on voltage for the first horizontal period H1 that is the current horizontal period.

As the described above, the j-th scan signal Sj has the turning-on voltage for the j-th horizontal period Hn that is the current horizontal.

The scan driver 140 is configured to the plurality of scan lines SL1, . . . , SLj, . . . SLN of the display panel 110 with the plurality of scan signals for the static image in response to the second start pulse signal.

The data driver 130 is configured to generate the data voltage of the static image and to provide the plurality of data lines DL1, . . . , DLi, . . . , DLM of the display panel 110 with the data voltage of the moving image (Step S216).

The emission driver 150 is configured to generate the plurality of emission control signals E1, . . . , Ej, . . . , EN and to provide the plurality of emission control lines EL1, . . . , ELj, . . . , ELN of the display panel 110 with the plurality of emission control signals E1, . . . , Ej, . . . , EN (Step S218).

Therefore, the display panel 110 may display the static image.

The static image does not need to improve the step effectiveness S/E. Thus, in the static image mode, the display quality of static images may be improved by eliminating or reducing text ghost phenomena.

According to the exemplary embodiment, in the static image mode, the text ghost phenomena may be eliminated or reduced by using a general scan signal without pre-charged data voltage of the previous pixels.

Figure 6:
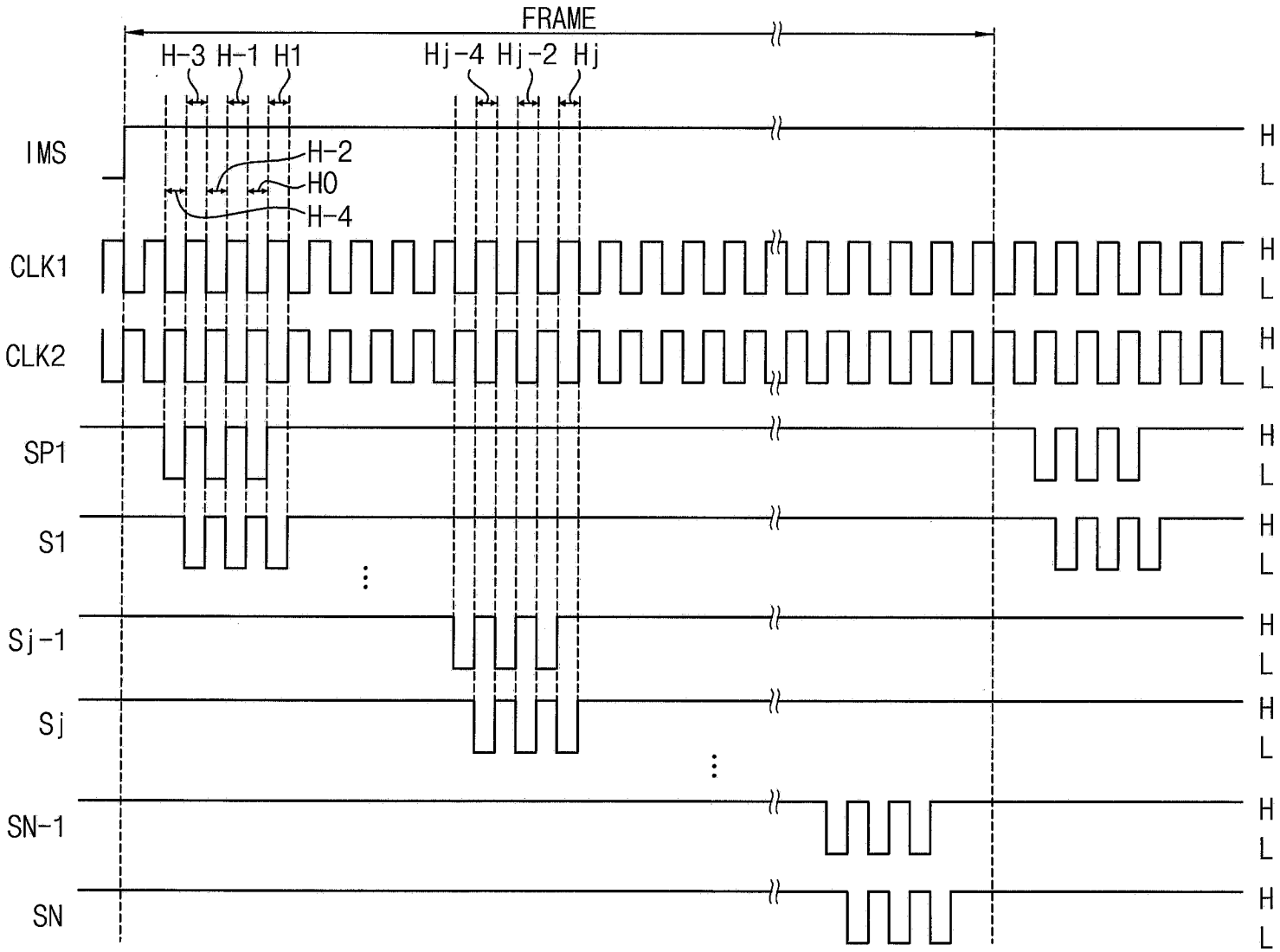
FIG. 6 is a waveform diagram illustrating a method of displaying a moving image according to one exemplary embodiment.

FIG. 6 is a waveform diagram illustrating a method of displaying a moving image according to one exemplary embodiment.

Referring to FIGS. 5 and 6, the method of displaying a moving image is explained when 'q' is a 3 and 'k' is 2 and 4.

When the image information signal IMS of the high voltage corresponding to the moving image is received, the timing controller generates the first start pulse signal SP1 of the MC 3-clk mode.

The first start pulse signal SP1 has a low voltage L for a current horizontal period H0, a first previous horizontal period H−2 being prior to the current horizontal period H0 by a 2 horizontal period and a second previous horizontal period H−4 being prior to the current horizontal period H0 by a 4 horizontal period. The low voltage L is the turning-on voltage turning on the P-type transistor.

The first circuit stage of the scan driver receives the first start pulse signal SP1 as the carry signal, and outputs the first scan signal S1 which has a same phase as the first start pulse signal SP1 and is delayed by 1 horizontal period 1H from the first start pulse signal SP1. The first scan signal S1 has the low voltage L for the first horizontal period H1, the first previous horizontal period H−1 and the second previous horizontal period H−3.

As the described above, the j-th circuit stage of the scan driver receives the (j−1)-th scan signal Sj−1 as the carry signal, and outputs the j-th scan signal Sj which has a same phase as the (j−1)-th scan signal Sj−1 and is delayed by 1 horizontal period 1H from the (j−1)-th scan signal Sj−1. The j-th scan signal Sj has the low voltage L for the j-th horizontal period Hn, the first previous horizontal period Hn−2 and the second previous horizontal period Hn−4.

According to the exemplary embodiment, to compensate for the decreased step effectiveness S/E due to the hysterical characteristics of the transistor, the scan signal of the MC 3-clk mode is applied to the pixel circuit. The pixel circuit receives pre-charged data voltages before the self data voltage is applied and thus, the step effectiveness S/E may be increased. Therefore, the quality of the moving image may be improved by increasing the step effectiveness S/E in the moving image mode.

Figure 7:
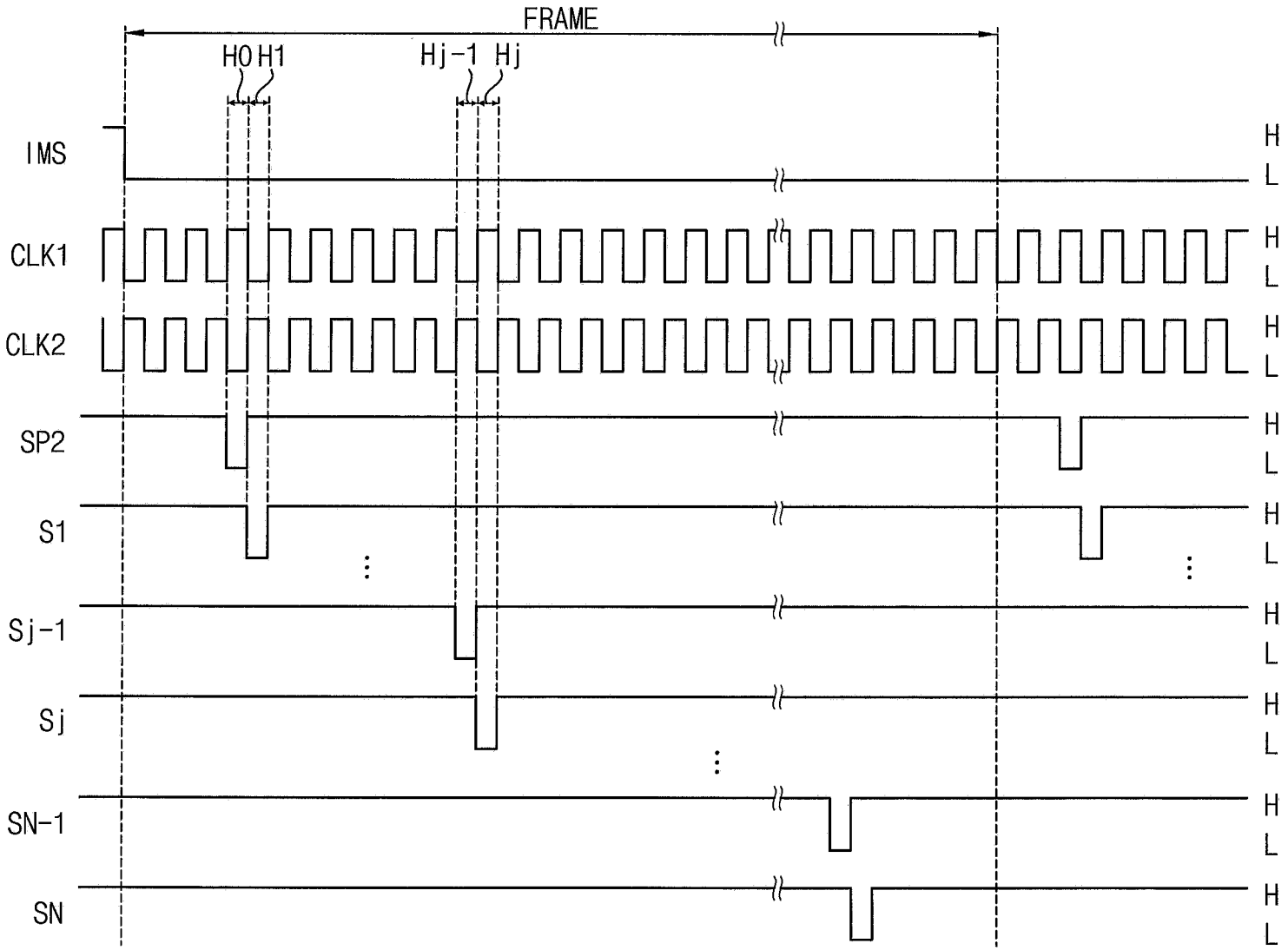
FIG. 7 is a waveform diagram illustrating a method of displaying a moving image according to one exemplary embodiment.
Figure 8A:
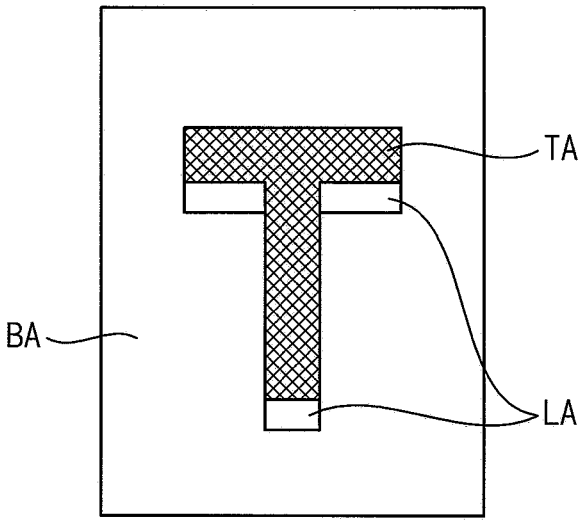
FIGS. 8A and 8B are conceptual diagrams illustrating display images according to one exemplary embodiment.
Figure 8B:
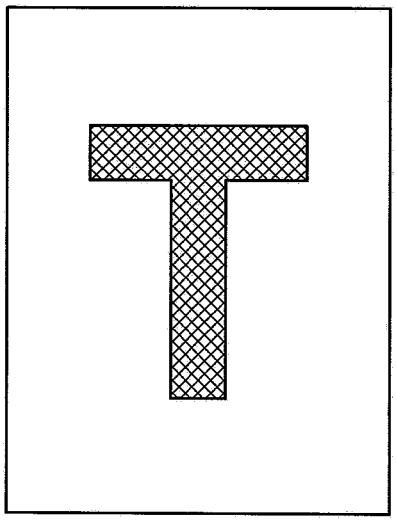

FIG. 7 is a waveform diagram illustrating a method of displaying a moving image according to one exemplary embodiment. FIGS. 8A and 8B are conceptual diagrams illustrating display images according to one exemplary embodiment.

Referring to FIGS. 5 and 7, when the image information signal IMS of the low voltage corresponding to the static image is received, the timing controller generates the second start pulse signal SP2 of the MC 1-clk mode.

The second start pulse signal SP2 has the low voltage L for the current horizontal period H0. The low voltage L is the turning-on voltage turning on the P-type transistor.

The first circuit stage of the scan driver receives the second start pulse signal SP2 as the carry signal, and outputs the first scan signal S1 which has a same phase as the second start pulse signal SP2 and is delayed by 1 horizontal period 1H from the second start pulse signal SP2. The first scan signal S1 has the low voltage L for the first horizontal period H1.

As the described above, the j-th circuit stage of the scan driver receives the (j−1)-th scan signal Sj−1 as the carry signal, and outputs the j-th scan signal Sj which has a same phase as the (j−1)-th scan signal Sj−1 and is delayed by 1 horizontal period 1H from the (j−1)-th scan signal Sj−1. The j-th scan signal Sj has the low voltage L for the j-th horizontal period Hn.

When the scan signal of the MC 3-clk mode is applied to the pixel circuit, the previous data voltage is applied to the pixel circuit before the self data voltage is applied. Thus, an on-bias of the pixel circuit is changed.

As shown in FIG. 8A, a screen displaying a text include a text area TA displaying the text and a lower area LA of the text area TA and a background area of the text. When comparing the lower area LA to the background area BA, the previous area for the column direction in the lower area LA is the text area TA. The pixel circuit in the lower area LA receives the previous data voltage such as a black data voltage and thus, has a relatively strong on-bias.

However, the previous area for the column direction in the background area BA is the background area BA. The pixel circuit in the previous data voltage receives the previous data voltage being the same as the self data voltage such as a white data voltage and thus, has relatively weak on-bias.

A pixel luminance of the lower area LA is changed by the black data voltage applied to the text area TA. These luminance changes may be increased luminance in the lower area LA below the text, i.e. the text ghost phenomenon.

Therefore, in the static image mode, there is no need to increase step effectiveness S/E, so the general scan signal may be applied to the pixel circuit as shown in the FIG. 8.

According to the exemplary embodiments, the scan signal has the turning-on voltage for the current horizontal period and at least one previous horizontal period is used in the moving image mode, and thus, the step efficiency S/E of the moving image may be improved. In addition, the general scan signal is used in the static image mode, and thus, the text ghost phenomenon of the static image may be eliminated or reduced.

The present exemplary embodiments may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising: a display panel comprising:

a scan line, a data line, and an emission control line;

a pixel comprising: a plurality of transistors connected to the scan line, the data line and the emission control line; and an organic light-emitting diode driven by the plurality of transistors; and a scan driver configured to: in response to an image mode being a moving image mode, generate a first mode scan signal having a turning-on voltage of a transistor for a plurality of horizontal periods; and in response to the image mode being a static image mode, generate a second mode scan signal having the turning-on voltage for a single horizontal period, wherein the first mode scan signal has the turning-on voltage for a current horizontal period and at least one previous horizontal period, and the at least one previous horizontal period is prior to the current horizontal period by a k horizontal period, and wherein 'k' is an even number which is equal to or more than 2.

2. The display device of claim 1, further comprising a timing controller configured to provide:

a first mode start pulse signal having the turning-on voltage for a plurality of horizontal periods with the scan driver in the moving image mode; and a second mode start pulse signal having the turning-on voltage for a single horizontal period with the scan driver in the static image mode.

3. The display device of claim 2, wherein the scan driver is configured to output a first scan signal to a scan line of the display panel in response to a start pulse signal, wherein the first scan signal has a same phase as the start pulse signal and is delayed by a horizontal period from the start pulse signal.

4. The display device of claim 1, wherein the first mode scan signal has the turning-on voltage for q number of horizontal periods, wherein 'q' is a number which is equal to or more than 2.

5. The display device of claim 1, wherein the pixel comprises:

a switching transistor configured to apply a data voltage to a capacitor in response to a scan signal;

a driving transistor configured to transfer a driving current toward the organic light-emitting diode based on a voltage charged in the capacitor; and a light-emitting transistor configured to apply the driving current to the organic light-emitting diode in response to an emission control signal.

6. The display device of claim 5, wherein the pixel further comprises an initializing transistor configured to apply an initialization voltage to the capacitor in response to a pixel initialization signal.

7. The display device of claim 6, wherein when the scan signal is an j-th scan signal, the pixel initialization signal is an (j−1)-th scan signal.

8. The display device of claim 5, further comprising an emission driver is configured to output the emission control signal to the emission control line.

9. The display device of claim 1, wherein the transistor is a P-type transistor.

10. A method of driving a display device which comprises a pixel comprising a plurality of transistors connected to a scan line, a data line and an emission control line and an organic light-emitting diode driven by the plurality of transistors in response to a display mode, the method comprising:

generating, in response to the display mode being a moving image mode, a first mode scan signal having a turning-on voltage of a transistor for a plurality of horizontal periods; and generating, in response to the display mode being a static image mode, a second mode scan signal having the turning-on voltage for a single horizontal period, wherein the first mode scan signal has the turning-on voltage for a current horizontal period and at least one horizontal period prior to the current horizontal period by a k horizontal period, and wherein 'k' is an even number which is equal to or more than 2.

11. The method of claim 10, further comprising:

generating, in response to the display mode being the moving image mode, a first mode start pulse signal having the turning-on voltage for a plurality of horizontal periods; and generating, in response to the display mode being the static image mode, a second mode start pulse signal having the turning-on voltage for a single horizontal period.

12. The method of claim 11, further comprising:

transmitting a first scan signal to a scan line of the display device in response to a start pulse signal, wherein the first scan signal has a same phase as the start pulse signal and is delayed by a horizontal period from the start pulse signal.

13. The method of claim 10, wherein the first mode scan signal has the turning-on voltage for q number of horizontal periods, wherein 'q' is a number which is equal to or more than 2.

14. The method of claim 10, wherein the pixel comprises:

a switching transistor configured to apply a data voltage to a capacitor in response to a scan signal;

a driving transistor configured to transfer a driving current toward the organic light-emitting diode based on a voltage charged in the capacitor; and a light-emitting transistor configured to apply the driving current to the organic light-emitting diode in response to an emission control signal.

15. The method of claim 14, wherein the pixel further comprises an initializing transistor configured to apply an initialization voltage to the capacitor in response to a pixel initialization signal.

16. The method of claim 15, wherein when the scan signal is an j-th scan signal, the pixel initialization signal is an (j−1)-th scan signal.

17. The method of claim 14, further comprising outputting output the emission control signal to the emission control line.

18. The method of claim 10, wherein the transistor is a P-type transistor.

* * * * *